United States Patent [19]

Scrivner

[11] Patent Number: 4,597,566

[45] Date of Patent: Jul. 1, 1986

[54] SPRING DECK FOR UPHOLSTERED SEATING

[75] Inventor: Jerry G. Scrivner, Ash Grove, Mo.

[73] Assignee: Flex-o-lators, Inc., Carthage, Mo.

[21] Appl. No.: 721,898

[22] Filed: Apr. 10, 1985

[51] Int. Cl.[4] ..... F16F 3/04

[52] U.S. Cl. ..... 267/91; 267/102; 267/103; 267/110

[58] Field of Search ..... 267/110–112, 267/91–93, 80–81, 85, 88, 86, 90, 102, 94–99, 100–101, 103–109, 166, 33; 5/256, 255, 247, 248

[56] References Cited

U.S. PATENT DOCUMENTS

| | | | |
|---|---|---|---|
| 2,526,250 | 10/1950 | Matthaei, Jr. | 267/104 |
| 2,644,509 | 7/1953 | Dorton | 267/103 X |
| 3,210,064 | 10/1965 | Crosby | 267/103 |
| 3,397,914 | 8/1968 | Richardson | 267/107 X |

*Primary Examiner*—Douglas C. Butler
*Attorney, Agent, or Firm*—John A. Hamilton

[57] ABSTRACT

A spring deck for upholstered seating consisting of a thin deck sheet, flexible transversely of its plane but inelastic in its plane, arranged generally horizontally over an open seat frame, and being connected at its front and rear edges to the frame, the connection at its rearward edge being by edge springs resiliently yieldable toward its forward edge so that it may yield downwardly responsively to top loading, and vertically yieldable sub-springs disposed beneath the central portion of the deck sheet and biased to offset that portion of the deck sheet upwardly above a plane determined by its front and rear edge connections, so that a load imposed on the deck is supported first by the sub-springs and later by both the sub-springs and the edge springs. The forward edge of the deck sheet may be supported by springs which are vertically yieldable, but not yieldable toward the rear deck sheet edge, in order that the deck sheet provides a soft-edge yieldability at its forward edge.

10 Claims, 8 Drawing Figures

SPRING DECK FOR UPHOLSTERED SEATING

Figure 1:
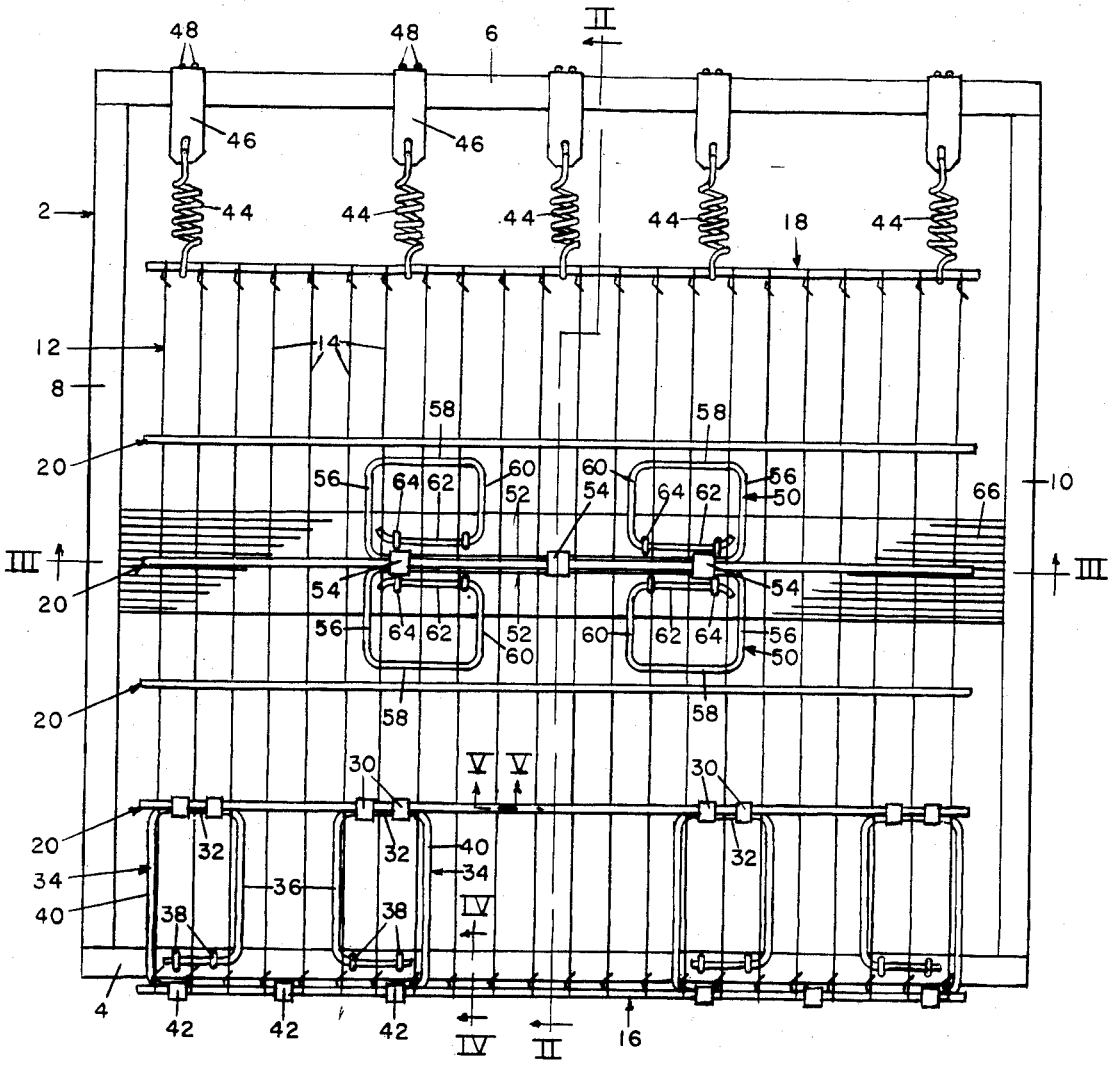

This invention relates to new and useful improvements in spring decks for upholstered seating, the spring deck being the spring structure disposed between the seat frame and the upholstery padding material of the seat structure to impart the additional soft, resilient yielding which is required to suit modern standards of comfort, and which cannot be obtained by the use of padding only.

A type of spring deck which has acquired wide popularity in comparatively recent years constitutes a thin wire deck sheet, resiliently flexible but inelastic in its own plane, usually formed of a resilient wire mesh or other material reinforced with spring wires, supported across a seat frame between a pair of its opposite edges, at least one of the edge supports being resiliently yieldable in the plane of the sheet so that the sheet may yield downwardly responsively to top loading thereof. The padding material is laid over the sheet, and secured in place by a cover sheet of durable, decorative material laid over the padding, drawn downwardly around the edges of the seat, and secured to the frame. This form of deck is substantially less expensive than the more traditional bed of vertical helical springs based in the frame and distributed over the area of the cushion, and also is more suited to the vertical space limitations imposed on the deck by the style of the so-called "thin-line" furniture. However, this sheet-type deck is also subject to certain disadvantages and shortcomings. First, it is not well adapted to provide a first easy and soft yieldability, giving a luxurious, deeply yielding sensation as required by prevailing standards of comfort, followed by a firming, more solid support to limit the total yield to bring it within the limitations of thin-line furniture. This defect results from the fact that the edge springs of the sheet deck must be substantially tensioned to provide even the minimum initial softness desired since any top loading of the deck is transferred to these edge springs with a substantial mechanical advantage and multiplication, since the top loading is applied generally at right angles to the deck and to its edge springs. This causes the deck to stiffen rapidly against further top loading, with the result that structures relying solely on a sheet deck of this type for spring support tend to be rather stiff and hard, and hence less comfortable, than structures utilizing vertical helical springs in a spring deck of a "mattress" type. Second, a sheet deck, being itself substantially planar, and being flexible and supported from a pair of opposite edges, tends to remain flat and planar, and to produce a seat cushion which is also flat and planar, not "crowned", or bulging upwardly toward its mid-portion. On the other hand, a crowned cushion is often preferred to a flat one, sometimes merely for reasons of style, and also because a crowned cushion tends to preserve a neat, taut, smoothly tailored appearance through a much longer period of use than a flat cushion, which often tends to assume a wrinkled, broken-down appearance after relatively short periods of use. Third, a flat sheet-type spring deck, being planar and mounted at its edges across a seat frame, often does not provide spring support over the front rail of the frame, but only the yielding support of the padding material applied thereover. This "hard-edge" cushion is not considered ideally comfortable, since it results in a bar-like effect, directly beneath the thighs of the user, which may interfere with the user's blood circulation. A "soft-edge" cushion, in which the forward edge is spring-supported and resiliently yieldable in a downward direction, is much preferred.

Accordingly, the object of the present invention is the provision of a spring deck for upholstered seating which, while taking full advantage of the economies of a sheet-type deck, nevertheless has additional features providing the soft initial yieldability discussed above, which may be termed a "pillow top" effect, and also providing for crowning of the cushion and for a soft-edge effect at its forward edge.

This object is accomplished principally by the use of vertically yieldable sub-springs, disposed beneath the central portion of the sheet deck and based on the seat frame, with the sub-springs tensioned to hold the central sheet portion at a slightly higher elevation than that at which it would be disposed if it were positioned and tensioned solely by its own edge supports. This elevation of course provides the crowning of the cushion. It also provides that the edge support springs of the sheet deck are actually normally tensioned in a reverse direction, that is upwardly, before loading is applied to the cushion. When loading is then applied, said edge springs at first relax, applying no resistance to yielding of the cushion, and do not again come into play until the deck has been deflected below horizontal by the applied load. This delay in the effectiveness of the sheet edge springs provides the pillow-top effect, allowing a soft initial yield resisted only by the sub-springs, followed by a rapid firming of support as the edge springs come into play. The soft-edge effect at the forward edge of the cushion is supplied by securing the forward edge of the deck sheet not directly to the front frame rail, but to a series of forwardly-opening fish-mouth springs attached to said frame rail in such a manner that the forward edge of the sheet deck may yield downwardly.

Other objects are simplicity and economy of construction, efficiency and dependability of operation, and adaptability for use in a wide variety of types and styles of seating.

Figure 2:
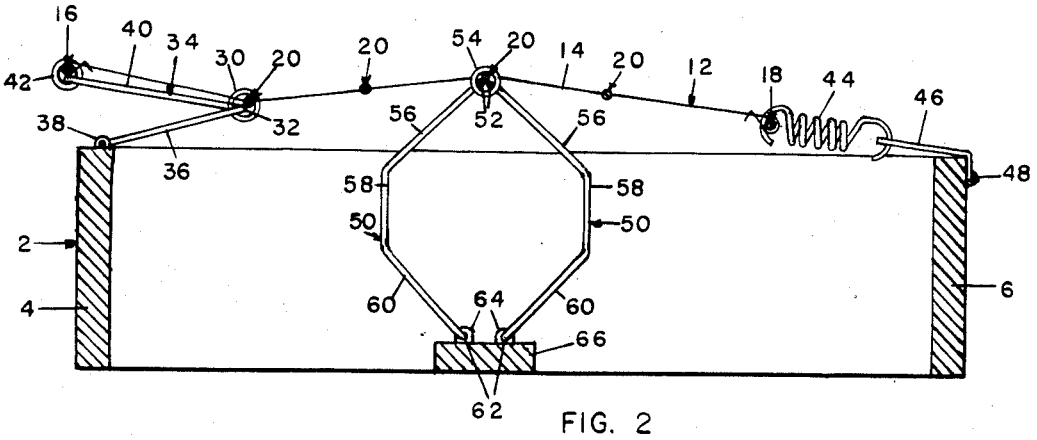
Figure 3:
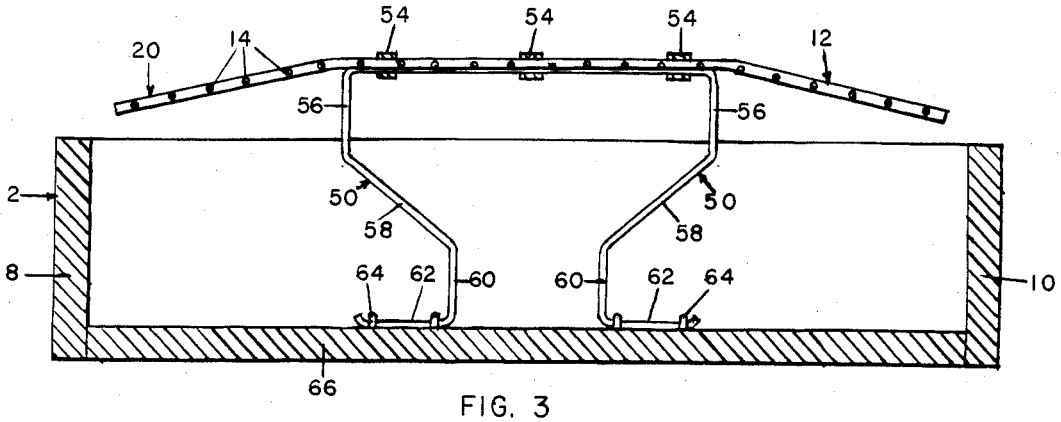
Figure 4:
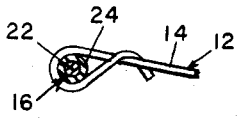
Figure 5:
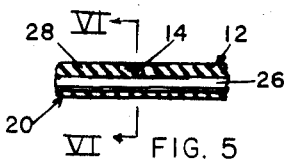
Figure 6:
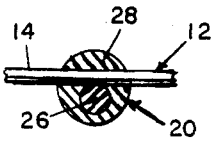
Figure 7:
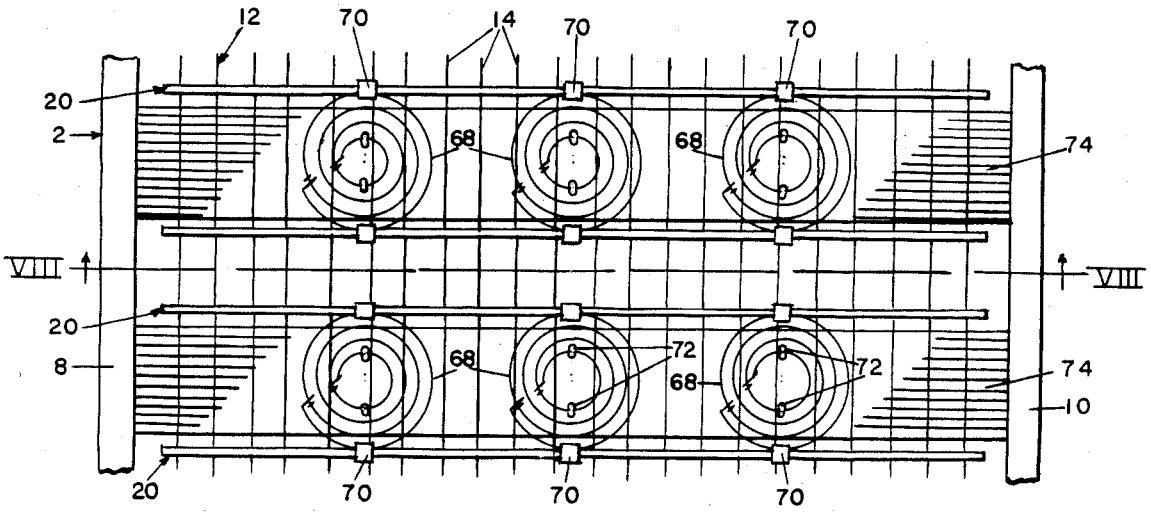
Figure 8:
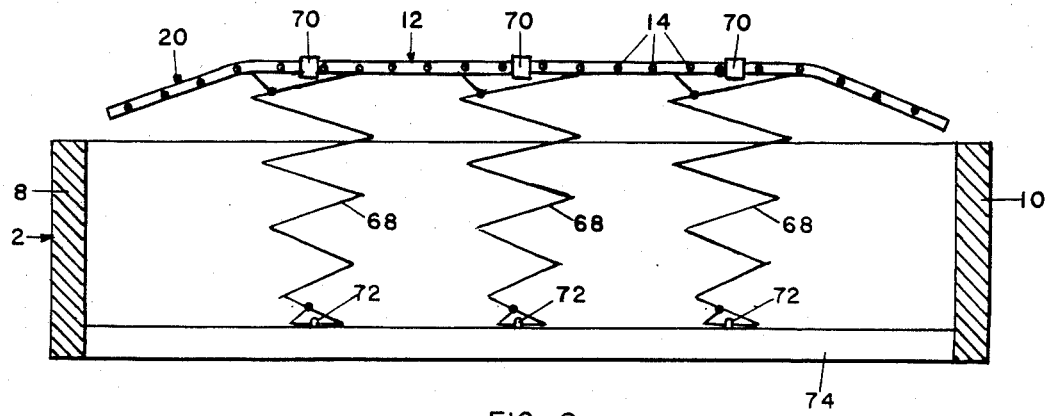

With these objects in view, as well as other objects which will appear in the course of the specification, reference will be had to the accompanying drawing, wherein:

FIG. 1 is a top plan view of a seating frame, showing a spring deck embodying the present invention operatively mounted therein, FIG. 2 is a sectional view taken on line II—II of FIG. 1, FIG. 3 is a sectional view taken on line III—III of FIG. 1, FIG. 4 is an enlarged, fragmentary sectional view taken on line IV—IV of FIG. 1, FIG. 5 is an enlarged, fragmentary sectional view taken on line V—V of FIG. 1, FIG. 6 is an enlarged, fragmentary sectional view taken on line VI—VI of FIG. 5, FIG. 7 is a fragmentary view similar to FIG. 1, showing only the central portion of the deck, illustrating a modification of a structure, and FIG. 8 is a sectional view taken on line VIII—VIII of FIG. 7.

Like reference numerals apply to similar parts throughout the several views, and the numeral 2 applies generally to a seat frame of an ordinary type, consisting of a front rail 4, rear rail 6 and side rails 8 and 10, all rigidly joined together to form an open, rectangular frame, normally disposed generally horizontally. The spring deck forming the subject matter of the present invention includes a generally rectangular flexible spring deck sheet 12 extending over the top of frame 2. Said deck sheet consists of a series of closely spaced parallel spring steel wires 14 extending longitudinally from the front frame rail 4 to a point spaced forwardly from rear frame rail 6, a pair of strands 16 and 18 extending transversely to wires 14 respectively at the forward and rearward edges of the sheet, and a plurality of transverse strands 20 spaced between strands 16 and 18 and parallel thereto. Each of strands 16 and 18 comprises a relatively heavy spring steel wire 22 encased in a sheath 24 of relatively soft, indentable material such as twisted paper, plastic or rubber, as best shown in FIG. 4. The ends of each wire 14 are "knotted" about transverse strands 16 and 18, that is, are bent around said strands and then hooked about their own standing portions. Each intermediate transverse strand 20 comprises a relatively heavy spring steel wire 26 encased in a relatively soft sheath 28, as best shown in FIGS. 5 and 6, with wires 14 piercing said sheaths at each of their points of intersection therewith so as to lie substantially tangential to wires 26. This construction of sheet 12 lends itself well to highspeed production by automatic machinery.

The first intermediate transverse strand 20 behind front transverse strand 16 is secured as by sheet metal clips 30 to the horizontal transversely extending apex arms 32 of a series of forwardly opening fish-mouth springs 34, each of said springs comprising a length of heavy spring wire including said apex arm, a forwardly extending lower leg 36 secured at its forward end to the top of front frame rail 4 by staples 38, and a forwardly extending upper leg 40 secured at its forward end to front transverse strand 16 of deck sheet 12 by sheet metal clips 42. Thus the forward edge of deck sheet 12 is resiliently supported in spaced relation above front frame rail 4, and may yield downwardly in response to top loading thereof. The rearward transverse strand 18 of deck sheet 12 is supported by a series of helical edge springs 44 spaced across the width of the deck sheet. Each of springs 44 is hooked at its forward end about strand 18, and is hooked at its rearward end into the forward end of a vertically flexible strap 46, said strap being affixed at its rearward end to rear frame rail 6 by staples 48. Thus deck sheet 12, which is resiliently flexible transversely of its plane but inelastic to forces applied thereto in its plane, may yield downwardly with a "hammocking" action in response to top loading thereof. The engagement of springs 44 only with the soft sheath 24 of strand 18, and the free vertical flexibility of straps 46, tends to prevent rubbing or grating wire noises.

Generally midway between the front and rear rails of frame 2, deck sheet 12 is supported by a pair of sub-springs 50. Each of said sub-springs comprises a length of heavy spring wire having a central portion 52 lying along one of intermediate strands 20 of deck sheet 12 and secured thereto by sheet metal clips 54, a series of three downwardly inclined legs 56, 58 and 60 extending from each end of the central portion, and a horizontal bottom leg 62 at the lower end of each leg 60. Bottom legs 62 are affixed by staples 64 to a base bar 66 extending between side rails 10 of frame 2, and forming a part of said frame. Sub-springs 50, as well as fish-mouth springs 34 are so arranged that certain legs thereof, notably legs 58 of the sub-springs, and legs 32 of the fish-mouth springs, yield principally in torsional twisting rather than in lateral flexing. This relieves said springs of much of the stress concentrations which would otherwise occur, principally at the bends of said wires, and which could result in relatively early failure and breakage of the wires. Sub-springs 50 have sufficient strength to deflect deck sheet 12 upwardly from the plane it would normally occupy if supported only by edge springs 44, as clearly shown in the drawing. This applies tension to the edge springs, which in turn pre-tensions the sub-springs by applying a downward load thereto. The balance between the sub-springs end edge springs should be so set that when at rest, the sub-springs have a tension sufficient only to provide the minimum resistance to downward yielding required for the soft initial yield needed in a pillow-top cushion. Although not shown in the drawing, for reasons of clarity, a layer of upholstery padding material is applied over the deck as shown, and the seat is finished by applying a cover sheet over the padding material, and drawing it down for attachment at its edges to frame 2.

In operation, it is of course readily apparent that the offsetting of the central portion of deck sheet 12 above a plane established by its front and rear edge connections, when the seat is unoccupied, provides the desired crowning of the cushion, which is sometimes considered more attractive than a flat, planar cushion, and which assists in the retention of a neat, taut and tailored appearance by the overlying padding and cover sheet layers. Also, the positioning of the forward edge of sheet 12 in spaced apart relation above the upper edge of front frame rail 4 by fish-mouth springs 34 permits said forward edge to yield downwardly in response to top loading, which provides the desired soft-edge effect. When a user starts to lower himself into the cushion, but before he has settled his full weight, the initial resistance to yielding is supplied only by sub-springs 50, since edge springs 44 are actually biasing the deck downwardly at this time. In fact, the tension of springs 44 is relaxing to a degree at this time. Only when the deck sheet passes downwardly through the plane established by its front and rear edge connections, and begins to flex downwardly under the increasing load, do springs 44 again begin to be extended to increase their resistance to downward yielding. The load is then being supported by both the sub-springs and the edge springs, and the yield resistance of the edge springs then increases rapidly for the reason given above, that is, because the vertical direction of load application is generally at right angles to the edge springs, so that the load is transferred to the edge springs with a multiplication resulting from the mechanical advantage of the transfer. The initial period when the load is supported principally only by the sub-springs provides the initial soft yieldability providing the desired "pillow top" effect, while the rapidly added support provided by edge springs 44 during later portions of the total yield provides the firmer support underlying the pillow top action, in order to limit the total yield to an amount dictated by the space limitations of so-called thin-lined furniture. Moreover, since the load assumption by the edge springs is gradual, even though rapid, the transition from a condition in which support is supplied principally by the sub-springs, to a condition in which support is supplied by both sets of springs, is sufficiently smooth and "stepless" that the user is normally not conscious of it, and suffers no discomfort.

In the modification shown in FIGS. 7 and 8, the deck is substantially identical to that shown in FIGS. 1–6, corresponding parts being indicated by corresponding numerals, except that in place of the bent wire torsion springs 50 used as sub-springs in FIGS. 1–6, the modification uses a plurality (number optional depending on the strength used) of vertical helical coil springs 68 of an ordinary "mattress" type. The top convolutions of each spring 68 are joined to certain of the intermediate transverse strands 20 of the deck sheet 12 by sheet metal clips 70, and the bottom convolutions of each spring 68 are affixed by staples 72 to base bars 74 forming a part of frame 2. The mode of operation of the modified form is generally identical to that of the preferred form shown in FIGS. 1–6, but the use of the coil type sub-springs has certain advantages in limited circumstances. For example, since the coil springs may be more widely spaced apart than the upper ends of torsion springs 50, they may be positioned to provide closer control of any specific crowning pattern which might be desired. Also, since a greater number of the coil springs would ordinarily be employed than the number of torsion springs used in a seat structure of the same size, the coil springs provide a convenient means for adjusting the total sub-spring support required in each individual seat design, by changing either the number or the wire weight of said coil springs. It should be noted that since the sub-springs are never called on to support the entire load, a large portion of the load being shifted to the edge springs in normal usage, the coil springs may be formed of a much lighter gauge wire than would be required if they were required to support the entire load, thus effecting a valuable economy.

While I have shown and described certain specific embodiments of my invention, it will be readily apparent that many minor changes of structure and operation could be made without departing from the spirit of the invention.

What I claim as new and desire to protect by Letters Patent is:

1. A spring deck for upholstered seating comprising:

a. an open seat frame, b. a thin deck sheet freely flexible transversely of its plane but inelastic in its plane, said sheet being arranged over said frame, c. means securing a pair of opposite edges of said deck sheet to corresponding edges of said frame, said securing means at at least one edge of said deck sheet being resiliently yieldable in the plane of said sheet, whereby said sheet would normally be held yieldably substantially in a plane determined by said edge securing means, but may yield resiliently downwardly responsively to top loading thereof, said deck sheet being adapted to support upholstery padding material thereover, and d. resilient sub-support means disposed beneath said deck sheet generally centrally between its edge securing means, said sub-support means being based in said frame, and being tensioned to deflect the central portion of said deck sheet upwardly from a plane determined by the edge securing means of said deck sheet, when said resilient edge securing means and said sub-support means are balanced and at rest, with no load applied to said deck sheet.

2. A spring deck as recited in claim 1 wherein said deck sheet comprises a fabric formed principally of spring steel wire.

3. A spring deck as recited in claim 1 wherein said deck sheet comprises:

a. a series of closely spaced parallel spring steel longitudinal wires extending forwardly and rearwardly of said seat frame, b. a plurality of spring steel transverse wires extending transversely to said longitudinal wires, and c. means connecting said longitudinal and transverse wires firmly together at each of their points of intersection, whereby to form an integrated wire fabric.

4. A spring deck as recited in claim 1 wherein said sheet deck securing means at the resiliently supported edge of said sheet deck comprises a series of heleical edge springs spaced across the width of said sheet and lying substantially in the plane of said deck, each of said edge springs being attached at one end to said deck sheet, and at its opposite extended end to said seat frame.

5. A spring deck as recited in claim 1 wherein said resilient sub-support means comprises a vertically yieldable spring based at its lower end in said seat frame, and supporting said deck sheet at its upper end.

6. A spring deck as recited in claim 1 wherein said sheet deck supporting means at the resiliently supported edge of said deck sheet comprises horizontally yieldable edge springs interconnecting that edge of said deck sheet to the corresponding edge of said frame, and wherein said sub-support means comprises a vertically yieldable subspring based in said frame and supporting said deck sheet at its upper end.

7. A spring deck as recited in claim 6 with the addition of vertically yieldable springs mounted on said frame at the edge thereof opposite that carrying said horizontally yieldable edge springs, and extending above said frame, the corresponding edge of said deck sheet being secured to the upper ends of said vertically yieldable springs, whereby that edge of said deck sheet may yield resiliently downwardly.

8. A spring deck as recited in claim 6 with the addition of a series of outwardly opening, vertically yieldable fish-mouth springs mounted in transversely spaced apart relation to the edge of said frame opposite to the deck sheet edge supported by said edge springs, each of said fish-mouth springs having a V-form providing a lower leg attached at its free end to said frame, and an upper leg resiliently yieldable downwardly toward said lower leg, said deck sheet being attached to the apices of said fish-mouth springs, and extending over the upper legs whereby to provide a spring deck having a downwardly yieldable edge.

9. A spring deck as recited in claim 1 wherein said resilient sub-support means comprises:

a. a plurality of bent wire sub-springs each formed by a wire having a series of straight, relatively angled legs vertically inclined to extend downwardly from said deck sheet, b. means securing the upper end of each of said sub-springs to said deck sheet, and c. means securing the lower end of each of said sub-springs to said frame in spaced relation below said deck sheet, said sub-springs being vertically yieldable and including at least one leg extending generally transversely to the direction of load application, whereby to be yieldable in torsion.

10. A spring deck as recited in claim 1 wherein said resilient sub-support means comprises:

a. a plurality of vertical helical springs arranged under the central portion of said deck sheet, b. means connecting the top convolution of each of said coil springs to said deck sheet, and c. means connecting the bottom convolution of each of said coil springs to said frame in spaced relation beneath said deck sheet.

* * * * *